United States Patent [19]

Gulli

[11] Patent Number: 4,774,776

[45] Date of Patent: Oct. 4, 1988

[54] BOUNCING ATTACHMENT FOR SHOES

[76] Inventor: Frank Gulli, 62 Livingston Ave., Dobbs Ferry, N.Y. 10522

[21] Appl. No.: 609,968

[22] Filed: May 14, 1984

[51] Int. Cl.[4] ..... A43B 7/14; A43B 7/32

[52] U.S. Cl. ..... 36/132; 36/7.8; 36/29; 272/70

[58] Field of Search ..... 36/136, 132, 29, 116, 36/1, 117, 114, 113, 7.8; 272/70

[56] References Cited

U.S. PATENT DOCUMENTS

| | | | |
|---|---|---|---|
| 250,108 | 11/1881 | Stewart | 36/7.8 X |
| 1,529,421 | 3/1925 | Dowdell | 36/7.8 X |
| 2,430,466 | 11/1947 | Hedman | 36/116 X |
| 2,756,517 | 7/1956 | Youtz | 36/7.8 |
| 4,288,930 | 9/1981 | Bornell | 36/132 |

FOREIGN PATENT DOCUMENTS

| | | | |
|---|---|---|---|
| 2314847 | 10/1974 | Fed. Rep. of Germany | 36/132 |
| 377897 | 8/1932 | United Kingdom | 36/20 |
| 777630 | 6/1957 | United Kingdom | 36/29 |

*Primary Examiner*—James Kee Chi

*Attorney, Agent, or Firm*—William L. Fisher

[57] ABSTRACT

Improvement in an attachment for shoes in which a hollow body inflated with air and compressed in use is held on each shoe of a user, the improvement comprising constructing the attachment so that it is a bouncing attachment which provides a bounce for the user in walking, running and jumping, the attachment comprising the body having height, length and width and a nearly spherical surface, an arrangement for holding a single such hollow body positioned beneath the arch of each shoe at the point of balance thereof so that the user is able to tilt on the body about such balance point and the portion of the body in contact with the sole of each shoe covering the entire arch thereof.

3 Claims, 2 Drawing Sheets

BOUNCING ATTACHMENT FOR SHOES

My invention relates to an attachment for shoes.

The principal object of my invention is the provision of an improved attachment for shoes which cushions the feet and provides an advantageous reaction force in use.

The foregoing object of my invention, and the advantages thereof will become apparent during the course of the following description, taken in conjunction with the accompanying drawings, in which.

Figure 1:
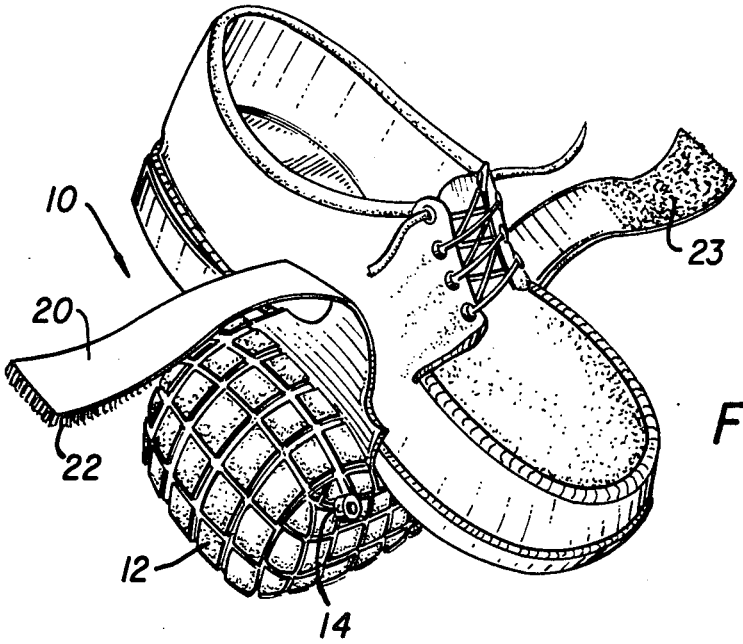
FIG. 1 is a perspective view of a shoe attachment embodying my invention shown in an uncompressed condition and associated with a shoe
Figure 2:
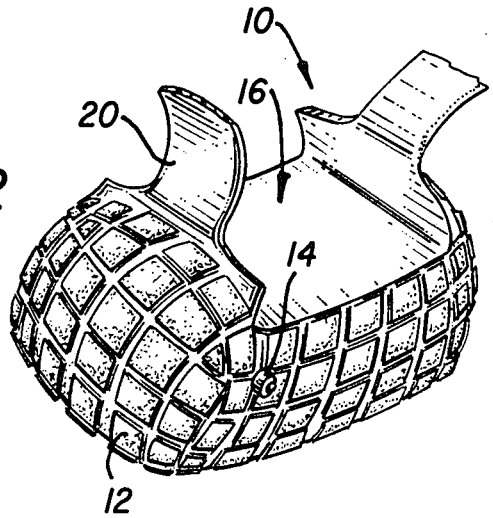
FIG. 2 is a perspective view of said shoe attachment shown in an uncompressed condition with parts cut away.

Referring to the drawings in greater detail, 10 generally designates said shoe attachment which I herewith designate "Gulli's Airshoe" as a trademark, which term I wish to have used whenever my shoe attachment is hereafter referred to. Said shoe attachment 10 comprises an inflatable hollow tire body 12 having height, length and width and a nearly spherical contact surface and a fill valve 14 for filling it with compressed air.

In its uncompressed condition, the body 12 has a height and length (front to back) substantially equal to each other and a width about 1½ times it height (or length). Said height (or length) is about 1½ times the width of the arch of a shoe last. Said body 12 has a shoe-retention mechanism 16 formed in its top surface and a friction tread 18 formed on its bottom surface for safety on wet surfaces. Said shoe-retention mechanism 16 is in the form of a depressed cavity having a flat platform bottom and inwardly tapered side walls, as shown, to enhance the rip on a user's shoe. The width of the platform proper is slightly larger than the width of the arch of a shoe last. Strap means 20 are provided for holding the user's shoe in said shoe-retention mechanism 16. In the instance shown, a strap having "Velcro" (a trademark) type fasteners 22,23 on the free ends thereof is provided for holding the shoe attachment 10 on the shoe of a user. If desired, the strap means 20 can be made of one piece with the body 12 so that the user's shoe can be inserted into a strong elastic strap means like entering a tunnel.

Figure 3:
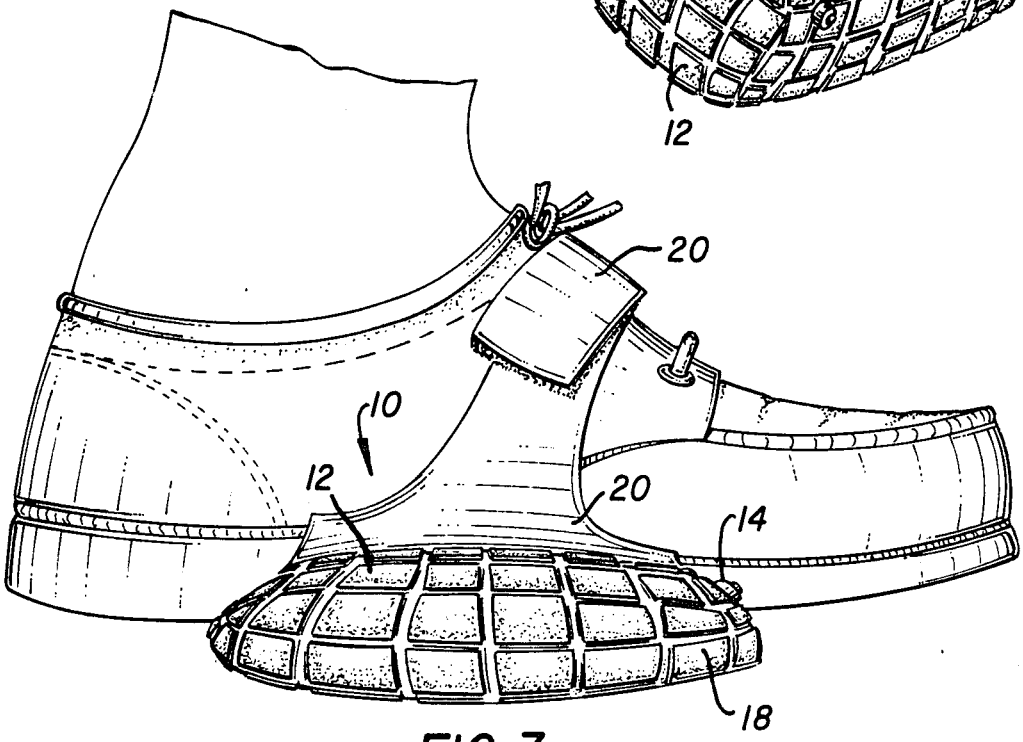
FIG. 3 is a side elevational view of said shoe attachment shown in a compressed condition in use on a user's shoe.
Figure 4:
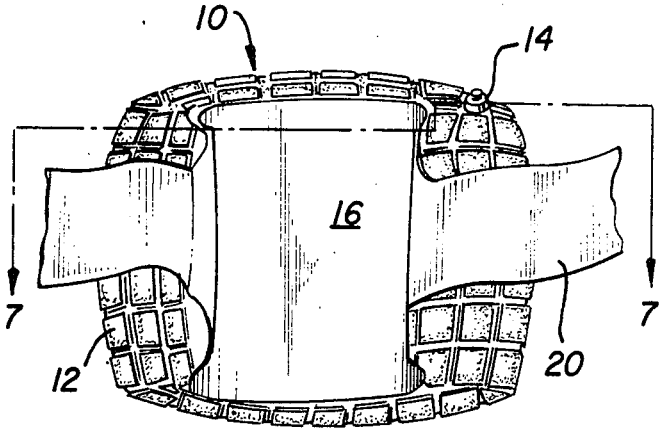
FIGS. 4–6 are, respectively, top plan, side elevational and bottom plan views of said shoe attachment shown in an uncompressed condition.
Figure 5:
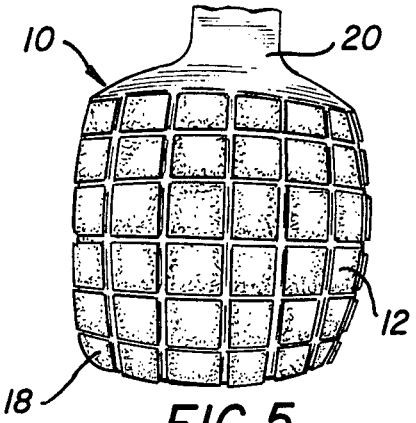
Figure 6:
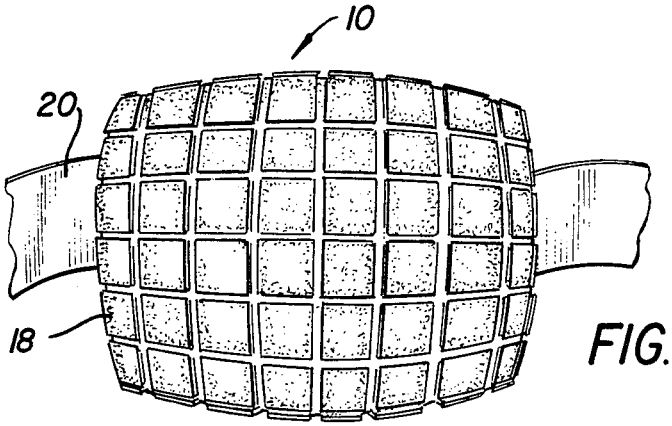
Figure 7:
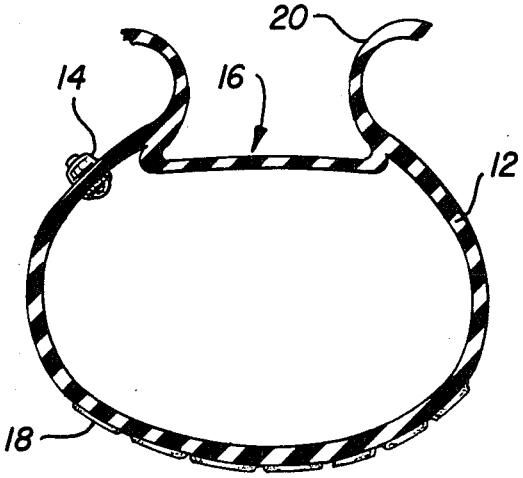
FIG. 7 is a vertical cross-sectional view of said shoe attachment taken on the line 6—6 on FIG. 3.

FIG. 3 indicates how the shoe attachment 10 is fitted on a wearer's shoe so that the body 12 is positioned beneath the arch so as to be located at the point of balance of the user's body, whereby his heel and sole are off the ground when standing, as shown. In use, the user's shoe tilts forward upon the body 12 and compresses it to cushion the feet and provide a bounce or spring for the user. The shoe attachment 10 can be inflated to an air pressure which best suits the user in a accordance with his weight and the amount of reaction force that he desires as he walks, runs or jumps. The attachment 10 can be hardened by inflating it with air for hard running and jumping and a lot of bounce or can be softened by letting out air for slower activities such as walking. In any event, the attachment 10 can be safely walked upon because the body 12 is always at the user's balance point.

It will thus be seen that there has been provided by my invention an improved attachment for shoes in which the object hereinabove set forth, together with many thoroughly practical advantages, has been successfully achieved. The shoe-attachment 10 can be used with safety and fun for all users. Long distance runners and joggers will find same to be extremely valuable because: (a) the hard wear and tear on their skeletal systems from the constant hammering to which they are subjected is substantially diminished, if not extremely eliminated entirely; and (b) the forward propulsion provided by the shoe-attachment 10 affords some ease in covering a given distance and saves time. While a preferred embodiment of my invention has been shown and described, it is to be understood that variations and changes may be resorted to without department from the spirit of my invention as defined by the appended claims.

What I claim is:

1. Improvement in an attachment from shoes in which a hollow body inflated with air and compressed in use is held on each shoe of a user, said improvement comprising constructing said attachment so that it is a bouncing attachment which provides a bounce for the user in walking, running and jumping, said attachment comprising said body having height, length and width and a nearly spherical contact surface, means for holding a single such hollow body positioned beneath the arch of each shoe at the point of balance thereof so the user is able to tilt on the body about such balance point and the portion of the body in contact with the sole of each shoe covering the entire arch thereof.

2. Improvement as claimed in claim 1 in which a shoe-retention mechanism is formed in the top surface of said body in the form of a depressed cavity having a flat platform bottom and inwardly tapered side walls to enhance the grip on a user's shoe.

3. Improvement as claimed in claim 2 in which the body is a tire body having a height and length substantially equal to each other and a width about 1½ times its height and in which said body has formed on its bottom surface a friction tread for safety on wet surfaces

* * * * *